US006466757B2

(12) United States Patent
Itaya et al.

(10) Patent No.: US 6,466,757 B2
(45) Date of Patent: Oct. 15, 2002

(54) DEVELOPING DEVICE USING A DEVELOPING LIQUID AND IMAGE FORMING APPARATUS INCLUDING THE SAME

(75) Inventors: Masahiko Itaya, Tokyo; Tsutomu Sasaki, Kanagawa; Yusuke Takeda, Kanagawa; Mie Yoshino, Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/785,203

(22) Filed: Feb. 20, 2001

(65) Prior Publication Data

US 2001/0021323 A1 Sep. 13, 2001

(30) Foreign Application Priority Data

Feb. 21, 2000 (JP) ..... 2000-042582

(51) Int. Cl.[7] ..... G03G 15/10

(52) U.S. Cl. ..... 399/249; 399/348; 399/354

(58) Field of Search ..... 15/256.5, 256.51, 15/250.48; 399/237, 239, 240, 249, 354, 357

(56) References Cited

U.S. PATENT DOCUMENTS

| | | | | |
|---|---|---|---|---|
| 5,021,834 A | | 6/1991 | Tsuruoka et al. | |
| 5,155,534 A | | 10/1992 | Kurotori et al. | |
| 5,642,188 A | | 6/1997 | Mochizuki et al. | |
| 5,652,080 A | | 7/1997 | Yoshino et al. | |
| 5,666,616 A | | 9/1997 | Yoshino et al. | |
| 5,708,938 A | | 1/1998 | Takeuchi et al. | |
| 5,923,930 A | | 7/1999 | Tsukamoto et al. | |
| 5,937,247 A | | 8/1999 | Takeuchi et al. | |
| 5,987,281 A | | 11/1999 | Kurotori et al. | |
| 5,999,779 A | | 12/1999 | Takeuchi | |
| 6,038,421 A | | 3/2000 | Yoshino et al. | |
| 6,061,540 A | | 5/2000 | Takeda | |
| 6,108,508 A | | 8/2000 | Takeuchi et al. | |
| 6,115,576 A | | 9/2000 | Nakano et al. | |
| 6,131,001 A | | 10/2000 | Tsukamoto et al. | |
| 6,134,394 A | | 10/2000 | Tsukamoto et al. | |
| 6,148,169 A | | 11/2000 | Tsukamoto | |
| 6,154,624 A | | 11/2000 | Sasaki et al. | |
| 6,236,825 B1 | | 5/2001 | Takeuchi | |
| 6,308,034 B1 | * | 10/2001 | Nakashima et al. | 399/249 |
| 6,311,034 B1 | * | 10/2001 | Nakashima et al. | 399/249 |
| 6,324,374 B1 | | 11/2001 | Sasamoto et al. | |
| 6,347,212 B1 | | 2/2002 | Kosugi et al. | |

OTHER PUBLICATIONS

U.S. application Ser. No. 09/517,082, filed Mar. 1, 2000, pending.
U.S. application Ser. No. 09/556,526, filed Apr. 21, 2000, pending.
U.S. application Ser. No. 09/785,203, filed Feb. 20, 2001, pending.

* cited by examiner

*Primary Examiner*—Arthur T. Grimley
*Assistant Examiner*—Hoang Ngo
(74) *Attorney, Agent, or Firm*—Oblon, Spivak, McClelland, Maier & Neustadt, P.C.

(57) ABSTRACT

A developing device of the type using a developing liquid and applicable to an image forming apparatus includes a developing roller and a sweep roller. The developing roller is pressed against a photoconductive drum to thereby form a nip. The sweep roller is positioned downstream of the nip in the direction of rotation of the drum and pressed against the drum in such a manner as to sandwich a developed toner layer. The surface of the sweep roller moves at substantially the same speed as the surface of the drum. A bias voltage (250 V) close to the surface potential (100 V to 200 V) of the toner layer formed on the drum is applied to the sweep roller. The bias causes the sweep roller to attract stray excess toner present on the background of the drum after development, thereby preventing a toner image from being blurred.

23 Claims, 2 Drawing Sheets

DEVELOPING DEVICE USING A DEVELOPING LIQUID AND IMAGE FORMING APPARATUS INCLUDING THE SAME

BACKGROUND OF THE INVENTION

The present invention relates to a copier, printer, facsimile apparatus or similar electrophotographic image forming apparatus. More particularly, the present invention relates to a developing device including at least one developer carrier for carrying a viscous, dense developing liquid, which consists of a carrier liquid and toner dispersed therein, and an applying member for applying the liquid to the developer carrier, and constructed to develop a latent image formed on an image carrier with the liquid deposited on the developer carrier.

Japanese patent application No. 11-38447, for example, discloses an image forming method that presses a developer carrier including an elastic layer against an image carrier to thereby form a nip. Specifically, a developing liquid, which consists of a carrier liquid and toner dispersed therein, is deposited on the developer carrier in a thin layer. The carrier liquid and toner are electrostatically transferred from the developer carrier to the image portion of the image carrier at the above nip. Only the carrier liquid is transferred to the background or non-image portion of the image carrier in a small amount at the nip. Even if the toner deposits on the background of the image carrier, it is caused to migrate toward the developer carrier at the nip.

However, the problem with the above-described prior art method is that the toner is apt to deposit on the background of the image carrier at the nip and remains thereon as excess toner. Such excess toner would blur the resulting toner image.

SUMMARY OF THE INVENTION

It is therefore an object of the present invention to provide a developing device capable of forming high quality images free from blur despite the use of a developing liquid, and an image forming apparatus including the same.

In accordance with the present invention, a developing device for developing a latent image formed on an image carrier with a developing liquid, which consists of a carrier liquid and toner dispersed therein, includes at least one developer carrier for carrying the developing liquid thereon. An applying member applies the developing liquid to the developer carrier. At least one removing member is located downstream of the developer carrier in the direction in which the surface of the image carrier moves, and removes excess toner present on the image carrier after development.

Also, in accordance with the present invention, an image forming apparatus using a developing liquid, which consists of a carrier liquid and toner dispersed therein, an image carrier, an image forming device for forming a latent image on the image carrier, a developing device for developing the latent image, and an image transferring device for transferring the developed image from the image carrier to a recording medium. The developing device includes at least one developer carrier for carrying the developing liquid, an applying member for applying the developing liquid to the developer carrier, and at least one removing member located downstream of the developer carrier in the direction in which the surface of the image carrier moves, and removes excess toner present on the image carrier after development.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
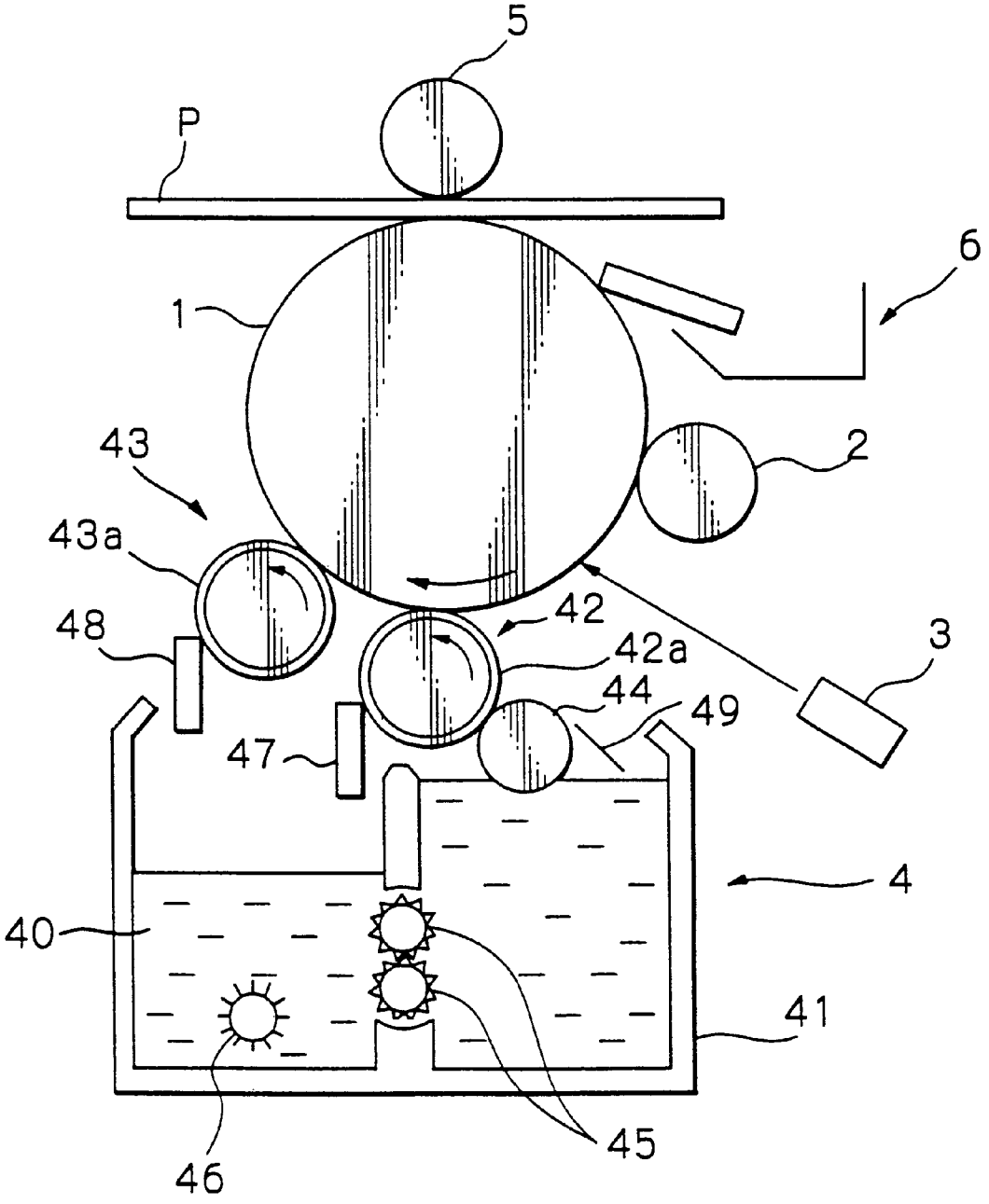
FIG. 1 is a front view showing an image forming apparatus embodying the present invention.

Referring to FIG. 1 of the drawings, an image forming apparatus embodying the present invention is shown and implemented as an electrophotographic copier by way of example. As shown, the copier includes a photoconductive drum 1 that is a specific form of an image carrier and formed of, e.g., a-Si or OPC (Organic PhotoConductor). Arranged around the drum 1 are a charge roller 2, an exposing unit 3, a developing unit or developing device 4, an image transferring unit 5, and a cleaning unit 6. The exposing unit 3 uses, e.g., LEDs (Light Emitting Diodes) or laser optics.

The operation of the copier shown in FIG. 1 will be described, assuming reversal development. A motor or similar drive source, not shown, causes the drum 1 to rotate at a constant speed in a direction indicated by an arrow in FIG. 1. The charge roller 2 uniformly charges the surface of the drum 1 to about 600 V in the dark. The exposing unit 3 exposes the charged surface of the drum 1 imagewise to thereby form a latent image representative of a document on the drum 1. The developing unit 4 develops the latent image for thereby forming a corresponding toner image.

The image transferring unit 5 transfers the toner image from the drum 1 to a paper sheet or similar recording medium P. After the paper sheet P has been separated from the drum 1, the cleaning unit 6 removes toner left on the drum 1. A discharge lamp, not shown, discharges potential remaining on the cleaned surface of the drum 1 to thereby prepare the drum 1 for the next copying cycle. The paper sheet P with the toner image is driven out of the copier via a fixing unit not shown.

For the image transferring unit 5, use may be made of an electrostatic roller, corona discharge or transfer using viscosity or heat. The fixing unit may use heat and/or pressure or a solvent.

The developing unit 4, which is the characteristic feature of the illustrative embodiment, stores a developing liquid 40 consisting of a carrier liquid and toner dispersed therein. The developing liquid 40 is a highly viscous, dense liquid different from the conventional low viscosity (about 1 cSt), low density (about 1%) liquid containing Isopar (trade name) available from Exon as a carrier. Specifically, the developing liquid 40 may have viscosity of 50 cSt to 5,000 cSt and density of 5% to 40%. The carrier liquid is selected from a group of highly insulative oils including silicone oil, normal paraffin, Isopar M (trade name) available from Exon, plant oil, and mineral oil. Either a volatile carrier liquid or a nonvolatile carrier liquid is used in accordance with the purpose. The grain size of toner may be selected from the range of from the order of submicrons to about 6 $\mu$m in accordance with the purpose.

The developing unit 4 includes a reservoir or tank 41 storing the developing liquid 40. The developing unit 4 further includes a developing roller 42, a sweep roller 43, a photogravure roller 44, a gear pump 45, and an agitator 46 implemented as a roller. Cleaning blades, or cleaning members, 47 and 48 are respectively associated with the developing roller 42 and sweep roller 43, and each is formed of metal or rubber. The blades 47 and 48 may be replaced with rollers, if desired. A doctor blade 49 is associated with the photogravure roller 44.

The developing roller 42 and sweep roller 43 respectively have conductive, elastic surface layers 42*a* and 43*a,* which may be formed of urethane rubber by way of example. The elastic layers 42*a* and 43*a* each should preferably have rubber hardness of 50° or below, as measured by JIS (Japanese Industrial Standards) A scale. Urethane rubber may be replaced with any other suitable conductive, elastic material that does not swell or dissolve in a solvent. An elastic layer may be formed on the drum 1, in which case the surfaces layers 42*a* and 43*a* will be omitted. The drum 1 maybe replaced with an endless photoconductive belt.

The sweep roller 43 is provided with smoothness of Rz 3 μm or below by coating or by use of a tube.

When the developing roller 42 and sweep roller 43 are pressed against the drum 1 by suitable pressure, the surface layers 42*a* and 43*a* each elastically deforms and forms a nip between it and the drum 1. The nip for development formed by the developing roller 42 guarantees a preselected period of time for development that allows toner contained in the developing liquid 40 to migrate toward and deposit on the drum 1 due to an electric field. By controlling the pressure to act on the drum 1, it is possible to control the width of each nip, i.e., the size in the direction of movement of the surface. The widths of the two nips each are selected to be greater than the product of the linear velocity of the associated roller and a time constant for development. The time constant for development refers to a period of time necessary for the amount of development to saturate and is produced by dividing the nip width by a process speed. For example, assuming that the nip width is 3 mm and the process speed is 300 mm/sec, then the time constant for development is 10 msec.

In the event of development, the photogravure roller 44 deposits the developing liquid 40 on the developing roller 42 in the form of a thin layer. In the illustrative embodiment, the liquid layer on the developing roller 42 has such a thickness that the toner deposited on the roller 42 contains a pigment by an amount of 0.1 μg or above, but 2 μg or below, for an area of 1 $cm^2$. For this purpose, the thickness of the liquid layer on the developing roller 42 is selected to be 5 μm to 10 μm. If the amount of pigment contained in the toner is smaller than 0.1 μg for the area of 1 $cm^2$, then the pigment is apt to fail to migrate to the latent image formed on the drum 1 in a sufficient amount, resulting in short image density. On the other hand, if the amount of pigment contained in the toner is greater than 2 μg, then the toner is apt to remain on the background of the drum 1 after development in an amount to great to be fully removed by the sweep roller 43.

The thin liquid layer formed on the developing roller 42 is conveyed via the nip between the roller 2 and the drum 1.

In electrophotographic developing devices in general, a developing roller is caused to move at a higher surface speed than a photoconductive element, so that a sufficient amount of toner can be fed to a region where the developing roller and photoconductive element face each other. This, however, causes toner to move at a high speed relative to the surface of the photoconductive element and thereby brings about positional deviation between the toner and a latent image formed on the photoconductive element. Consequently, a toner image is sometimes blurred at the leading edge portion thereof or sometimes has balance between vertical lines and horizontal lines disturbed. This is also true with development using a developing liquid.

The illustrative embodiment is free from the above-discussed problem because the surface of the developing roller 42 and that of the drum 1 move at substantially the same speed and inhibit the toner from having a vector in the tangential direction of the drum 1.

Figure 2A:
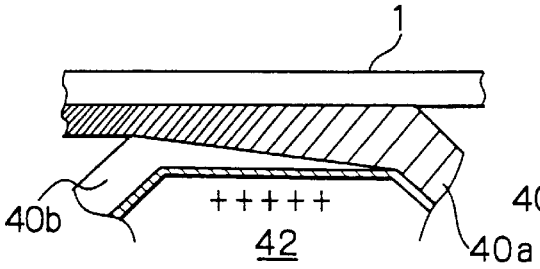
FIGS. 2A and 2B are views each showing a developing liquid reached a nip for development in a particular condition.
Figure 2B:
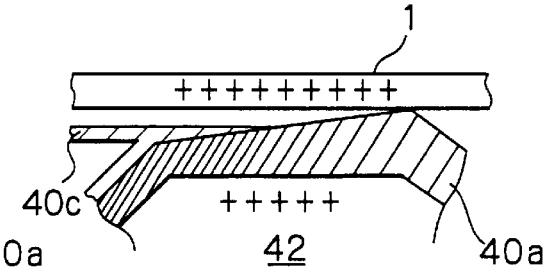

A bias for development (400 V) lower than the surface potential of the drum 1 (600 V) is applied to the developing roller 42. The bias forms an electric field between the developing roller 42 and the image surface whose potential has been lowered to 50 V or below by the exposing unit 3. As shown in FIG. 2A, in the image portion of the drum 1, toner 40*a* contained in the developing liquid 40 migrates to the drum 1 due to the above electric field, developing the latent image. As shown in FIG. 2B, in the background or non-image portion of the drum 1, the toner 40*a* migrates toward the surface of the developing roller 42 due to an electric field formed by the bias potential and drum potential. The toner 40*a* is therefore prevented from depositing on the background of the drum 1.

If part of the toner 40*a* in the background portion fails to reach the surface of the developing roller 42 and remains on the drum 1, then the toner 40*a* blurs the resulting toner image. In the illustrative embodiment, the sweep roller 43 sweeps the toner, labeled 40*c,* which would blur the toner image. Specifically, the sweep roller 43 is located downstream of the developing roller 43 in the direction of rotation of the drum 1 and pressed against the drum 1 in such a manner as to sandwich the developed toner layer. The surface of the sweep roller 43 moves at substantially the same speed as the surface of the drum 1.

Figure 3A:
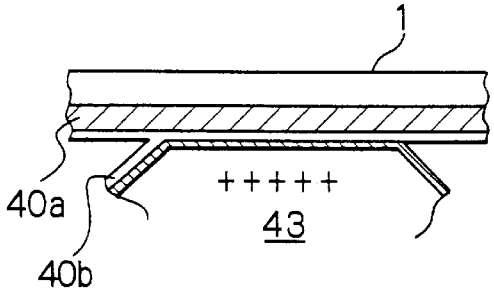
FIGS. 3A and 3B are views each showing the developing liquid reached a nip for removal in a particular condition.
Figure 3B:
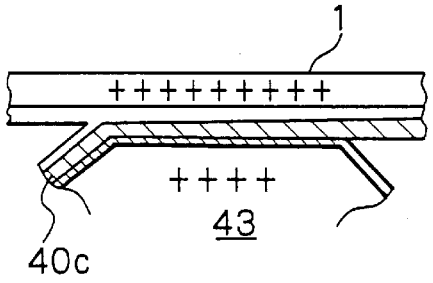

FIGS. 3A and 3B each shows the developing liquid 40 existing between the drum 1 and the sweep roller 43 in a particular condition. A bias voltage (250 V) close to the surface potential (100 V to 200 V) of the toner layer formed on the drum 1 is applied to the sweep roller 43. This bias prevents the toner 40*a* from returning to the developed toner layer to the sweep roller 43. Specifically, as shown in FIG. 3A, a difference between the potential of the background of the drum 1 and the potential of the above bias forms an electric field that causes the stray toner 40*c* to migrate toward the sweep roller 43. At this stage, the liquid layer on the background has a thickness that is about one-half of the thickness at the nip, and has a toner content that is about 20% of the toner content before development. The sweep roller 43 can therefore easily remove the undesirable toner 40*c,* so that blurring in the background is fully obviated. The potentials stated above have the following relation:

drum potential>VB1>VB2>toner layer potential where VB1 and VB2 respectively denote a potential between the drum 1 and the developing roller 42 and a potential between the drum 1 and the sweep roller 43.

Further, the sweep roller 43 is capable of removing about one half of the excessive carrier liquid deposited on the background of the drum 1 during development.

Moreover, because the sweep roller 43 efficiently removes the undesirable toner 40*c,* some toner 40*c* is allowed to remain at the nip between the drum 1 and the developing roller 42. It follows that an electric field necessary for removing the toner 40*c* and derived from a difference between the bias applied to the developing roller 42 and the drum charging potential can be lowered. This successfully enhances the durability of the drum 1, reduces the load on the charge roller 2, and reduces required power for exposure.

Specifically, a conventional image forming method is capable of causing a developer carrier to develop a latent image and to remove the above-stated undesirable toner at the same time. The conventional method, however, needs a relatively long period of time for development (e.g. about 40 seconds) and therefore a broad nip between an image carrier and the developer carrier. Because the conventional method forms the nip by pressing the developer carrier including an elastic layer against the image carrier, a broad nip is not attainable without resorting to high contact pressure.

By contrast, the developing unit 4 with the sweep roller 4 can assign only the developing function to the developing roller 42. This is successful to implement a nip width smaller than the conventional one and therefore to lower contact pressure to, e.g., 0.3 kgf/mm or below. Consequently, loads on the drum 1, developing roller 42 and sweep roller 43 are reduced to enhance durability.

While the illustrative embodiment shown and described has concentrated on reversal development, it is practicable even with regular development. In the case of regular development, the various potentials stated earlier will have the following relation:

drum potential>toner layer potential>VB2 >VB1>background potential where VB1 and VB 2 respectively denote a potential between the drum 1 and the developing roller 42 and a potential between the drum 1 and the sweep roller 43.

For example, the potential of the drum 1 is selected to be 600 V while the potential of the toner layer is selected to be 200 V to 300 V. Also, the voltages VB2 and VB1 are selected to be 200 V and 100 V, respectively. Further, the potential of the background of the drum 1 is selected to be 50 V.

In summary, it will be seen that the present invention provides an image forming apparatus, which includes a developing unit using a developing liquid, having various unprecedented advantages, as enumerated below.

(1) A removing member surely removes excess toner left on an image carrier after development, so that a high quality image free from blur is achieved.

(2) A developer carrier does not have to fully remove the excess toner because the removing member is present. This lowers charge potential required of the image carrier and thereby enhances the durability of the individual roller.

(3) The removing member is capable of removing part of the excess carrier present on the image carrier after development. This successfully lowers carrier consumption.

(4) A nip width for development can be reduced, compared to a construction lacking the removing member. The developer carrier can therefore be pressed against the image carrier by low pressure. This also enhances the durability of the individual roller.

(5) A voltage promotes efficient development and efficient toner removal at the same time.

(6) The surface of the developer carrier and that of the image carrier move at substantially the same speed and inhibit toner from having a vector in the tangential direction of the image carrier. This prevents an image from being blurred at the leading edge portion thereof or from having balance between vertical lines and horizontal lines from being disturbed.

(7) The developing liquid applied to the developer carrier has such a thickness that the toner deposited on the developer carrier contains a pigment by an amount of 0.1 $\mu$g or above, but 2 $\mu$g or below, for an area of 1 $cm^2$. An image is therefore free from short density or blur.

(8) Cleaning means assigned to the developer carrier removes the developer left on the surface of the developer carrier to thereby obviate irregular application. Further, cleaning means assigned to the removing member removes excess toner from the removing member, insuring the expected function of the removing member.

Various modifications will become possible for those skilled in the art after receiving the teachings of the present disclosure without departing from the scope thereof.

What is claimed is:

1. A developing device for developing a latent image formed on an image carrier with a developing liquid, which consists of a carrier liquid and toner dispersed therein, said developing device comprising:

at least one developer carrier configured to carry the developing liquid thereon;

an applying member configured to apply the developing liquid to said developer carrier; and at least one removing member located downstream of said developer carrier in a direction in which a surface of the image carrier moves, configured to remove by electrical bias excess toner present on said image carrier after development.

2. A developing device as claimed in claim 1, wherein said developer carrier and said removing member each are pressed against the image carrier to thereby form a respective nip.

3. A developing device as claimed in claim 2, further comprising:

first voltage applying means for applying a voltage to said developer carrier to thereby form an electric field between an image portion of the latent image and said developer carrier, said electric field causing the toner to migrate toward said image portion; and second voltage applying means for applying a voltage to said removing member to thereby form an electric field between a background portion of the image carrier and said removing member, said electric field causing said removing member to attract the excess toner, but not peeling off the toner deposited on the image portion.

4. A developing device as claimed in claim 3, wherein a surface of said developer carrier and a surface of the image carrier move at substantially a same speed as each other.

5. A developing device as claimed in claim 4, wherein a surface of said removing member and the surface of the image carrier move at substantially a same speed as each other.

6. A developing device as claimed in claim 5, wherein the toner contains a pigment, and wherein a thickness of the developing liquid applied to said developer carrier is selected such that a pigment content of the toner is 0.1 $\mu$g or above, but 2 $\mu$g or below.

7. A developing device as claimed in claim 6, further comprising:

first cleaning means for cleaning the surface of said developer carrier; and second cleaning means for cleaning the surface of said removing member.

8. A developing device as claimed in claim 1, further comprising:

first voltage applying means for applying a voltage to said developer carrier to thereby form an electric field between an image portion of the latent image and said developer carrier, said electric field causing the toner to migrate toward said image portion; and second voltage applying means for applying a voltage to said removing member to thereby form an electric field between a background portion of the image carrier and said removing member, said electric field causing said removing member to attract the excess toner, but not peeling off the toner deposited on the image portion.

9. A developing device as claimed in claim 8, wherein the surface of said developer carrier and the surface of the image carrier move at substantially a same speed as each other.

10. A developing device as claimed in claim 9, wherein the surface of said removing member and the surface of the image carrier move at substantially a same speed as each other.

11. A developing device as claimed in claim 10, wherein the toner contains a pigment, and wherein a thickness of the developing liquid applied to said developer carrier is selected such that a pigment content of the toner is 0.1 $\mu$g or above, but 2 $\mu$g or below.

12. A developing device as claimed in claim 11, further comprising:

first cleaning means for cleaning the surface of said developer carrier; and second cleaning means for cleaning the surface of said removing member.

13. A developing device as claimed in claim 1, wherein a surface of said developer carrier and a surface of the image carrier move at substantially a same speed as each other.

14. A developing device as claimed in claim 13, wherein a surface of said removing member and the surface of the image carrier move at substantially a same speed as each other.

15. A developing device as claimed in claim 14, wherein the toner contains a pigment, and wherein a thickness of the developing liquid applied to said developer carrier is selected such that a pigment content of the toner is 0.1 $\mu$g or above, but 2 $\mu$g or below.

16. A developing device as claimed in claim 15, further comprising:

first cleaning means for cleaning the surface of said developer carrier; and second cleaning means for cleaning the surface of said removing member.

17. A developing device as claimed in claim 1, wherein a surface of said removing member and the surface of the image carrier move at substantially a same speed as each other.

18. A developing device as claimed in claim 17, wherein the toner contains a pigment, and wherein a thickness of the developing liquid applied to said developer carrier is selected such that a pigment content of the toner is 0.1 $\mu$g or above, but 2 $\mu$g or below.

19. A developing device as claimed in claim 18, further comprising:

first cleaning means for cleaning the surface of said developer carrier; and second cleaning means for cleaning the surface of said removing member.

20. A developing device as claimed in claim 1, wherein the toner contains a pigment, and wherein a thickness of the developing liquid applied to said developer carrier is selected such that a pigment content of the toner is 0.1 $\mu$g or above, but 2 $\mu$g or below.

21. A developing device as claimed in claim 20, further comprising:

first cleaning means for cleaning the surface of said developer carrier; and second cleaning means for cleaning the surface of said removing member.

22. An image forming apparatus using a developing liquid consisting of a carrier liquid and toner dispersed therein, said image forming apparatus comprising: an image carrier;

image forming means for forming a latent image on said image carrier;

developing means for developing the latent image; and image transferring means for transferring a developed image from said image carrier to a recording medium;

said developing means comprising:

at least one developer carrier configured to carry the developing liquid thereon;

an applying member configured to apply the developing liquid to said developer carrier; and at least one removing member located downstream of said developer carrier in a direction in which a surface of the image carrier moves, configured to remove by electrical bias excess toner present on said image carrier after development.

23. An image forming apparatus using a developing liquid consisting of a carrier liquid and toner dispersed therein, said image forming apparatus comprising:

an image carrier;

an image forming device for forming a latent image on said image carrier;

a developing device for developing the latent image; and an image transferring device for transferring a developed image from said image carrier to a recording medium;

said developing device comprising:

at least one developer carrier configured to carry the developing liquid;

an applying member configured to apply the developing liquid to said developer carrier; and at least one removing member located downstream of said developer carrier in a direction in which a surface of said image carrier moves, configured to remove by electrical bias excess toner present on said image carrier after development.

* * * * *